US008262495B2

(12) United States Patent
Stites

(10) Patent No.: US 8,262,495 B2
(45) Date of Patent: Sep. 11, 2012

(54) VISUAL INDICATOR GOLF CLUB HEAD AND GOLF CLUBS

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 30 days.

(21) Appl. No.: 12/566,275

(22) Filed: Sep. 24, 2009

(65) Prior Publication Data

US 2011/0070964 A1 Mar. 24, 2011

(51) Int. Cl.
*A63B 69/36* (2006.01)
*A63B 53/04* (2006.01)

(52) U.S. Cl. ..... 473/226; 473/240; 473/242; 473/249; 473/256; 473/291; 473/334; 473/349; 473/350

(58) Field of Classification Search ..... 473/324–350, 473/287–292, 256, 231, 238, 240, 242, 249, 473/226
See application file for complete search history.

(56) References Cited

U.S. PATENT DOCUMENTS

| | | | | |
|---|---|---|---|---|
| 2,155,830 | A * | 4/1939 | Howard | 473/246 |
| 2,652,256 | A * | 9/1953 | Thomas | 473/333 |
| 3,979,122 | A | 9/1976 | Belmont | |
| 5,050,879 | A | 9/1991 | Sun et al. | |
| 5,082,278 | A | 1/1992 | Hsien | |
| 5,290,032 | A | 3/1994 | Fenton et al. | |
| 5,549,297 | A * | 8/1996 | Mahaffey | 473/290 |
| 5,683,309 | A * | 11/1997 | Reimers | 473/337 |
| 5,695,411 | A | 12/1997 | Wright et al. | |
| 5,769,737 | A * | 6/1998 | Holladay et al. | 473/336 |
| 6,015,354 | A | 1/2000 | Ahn et al. | |
| 6,450,897 | B2 * | 9/2002 | Stites et al. | 473/334 |
| 7,077,757 | B1 | 7/2006 | Payne et al. | |
| 7,147,573 | B2 * | 12/2006 | DiMarco | 473/324 |
| 7,166,041 | B2 * | 1/2007 | Evans | 473/334 |
| 7,201,669 | B2 * | 4/2007 | Stites et al. | 473/337 |
| 7,611,424 | B2 * | 11/2009 | Nagai et al. | 473/334 |
| 7,749,100 | B2 * | 7/2010 | Tavares et al. | 473/332 |
| 7,775,905 | B2 * | 8/2010 | Beach et al. | 473/334 |
| 2003/0203768 | A1 * | 10/2003 | Best | 473/345 |
| 2005/0090332 | A1 * | 4/2005 | Burrows | 473/345 |
| 2005/0137024 | A1 | 6/2005 | Stites et al. | |
| 2006/0240908 | A1 | 10/2006 | Adams et al. | |
| 2008/0020861 | A1 * | 1/2008 | Adams et al. | 473/334 |
| 2010/0234130 | A1 * | 9/2010 | Tavares et al. | 473/332 |

FOREIGN PATENT DOCUMENTS

JP 2006320493 A 11/2006

OTHER PUBLICATIONS

International Search Report and Written Opinion from PCT/US2010/042744 mailed Jan. 11, 2011.

* cited by examiner

*Primary Examiner* — Sebastiano Passaniti
(74) *Attorney, Agent, or Firm* — Banner & Witcoff, Ltd.

(57) ABSTRACT

A golf club head, golf club and a set of golf heads and clubs is provided with a center of gravity indicator mechanism housed on the rear side that may include a latitudinal strip and a center of gravity locator structure positioned on an axis transverse to the rear side and extending through the center of gravity of the body. The center of gravity locator structure may be fixed on a golf club head or may be variable. Additionally, a set of golf club heads is provided in which the center of gravity indicator mechanism is varied for each club in the set as the position of the center of gravity locator structure is varied for each of the golf club heads. The golf club heads may be coupled to shafts and grips and other features to form a golf club or golf club set.

18 Claims, 14 Drawing Sheets

VISUAL INDICATOR GOLF CLUB HEAD AND GOLF CLUBS

FIELD OF THE DISCLOSURE

The present disclosure relates to a golf club, more particularly, to a golf club head with a visual indicator relating to the center of gravity.

BACKGROUND

The alignment and swing of a golfer including the backswing and the downswing of a golfer is often related to the golfer's performance on the golf course. Golfers that can consistently swing a golf club in preferred manners may hit the golf ball farther, straighter and in a more consistent manner. Accuracy, control and direction may be improved when a golfer's swing has certain attributes associated with preferred swing directions and motion paths. Likewise, preferred alignment of the golf club head with the golf ball may also facilitate preferred golfer performance. However, many golfers have difficulty swing golf clubs according to certain preferred swing directions and motion paths. Similarly, golfers also have difficulty in aligning the golf club head to achieve preferred alignment for a golf club head with given attributes. Golfers with further understanding of the attributes of their golf club including the golf club head may swing the club in a preferred manner and may strike the golf ball so as to achieve preferred performance on the golf course by hitting the golf ball in a preferred manner including distance, spin, direction, trajectory, and path.

SUMMARY

Inventive aspects pertain to a golf club head with a center of gravity indicator mechanism housed on the rear side. The center of gravity indicator mechanism in certain configurations includes a latitudinal strip and/or a center of gravity locator structure positioned on an axis transverse to the rear side and extending through the center of gravity of the body. In certain configurations the center of gravity locator structure is fixed relative to that particular golf club head while in other configurations the center of gravity locator structure is variable in a position relative to the golf club head. The center of gravity locator structure may be housed within the latitudinal strip. The latitudinal strip may have any of a variety of configurations and shapes and may be oriented in a variety of directions including an orientation in which the length of latitudinal strip runs parallel with the top surface of the golf club head. The latitudinal strip may be pill-shaped or various other shapes. In variable configurations, the center of gravity locator may be moved using a variety of mechanisms to permit guided translation back and forth between a variety of positions. Other configurations may also be utilized and are described.

Other inventive aspects pertain to a set of golf club heads with a center of gravity indicator mechanism in which a center of gravity locator structure has a fixed position housed within a latitudinal strip at various positions depending on the particular club in the set. As one moves from long irons to middle irons to short irons in the set, the center of gravity locator structure on each particular golf club is housed in distinct positions moving from a sole or bottom heel end side for the longest (lowest numbered) long irons to a position closer towards to top and toe end for the shortest (highest numbered or pitching wedge) of the short irons. This varied location of the center of gravity locator structure varies directly with the location of the center of gravity of the golf club head as each golf club head in the set has the center of gravity located in a distinct position consistent with that described.

Further inventive aspects pertain to a variety of distinctly shaped and configured center of gravity indicator mechanisms. Additionally, further inventive aspects pertain to any of the golf club heads disclosed being coupled to shafts and grips as golf clubs or sets of golf clubs.

DESCRIPTION OF THE DRAWINGS

The foregoing Summary, as well as the following Detailed Description, will be better understood when read in conjunction with the accompanying drawings.

DETAILED DESCRIPTION

Figure 1A:
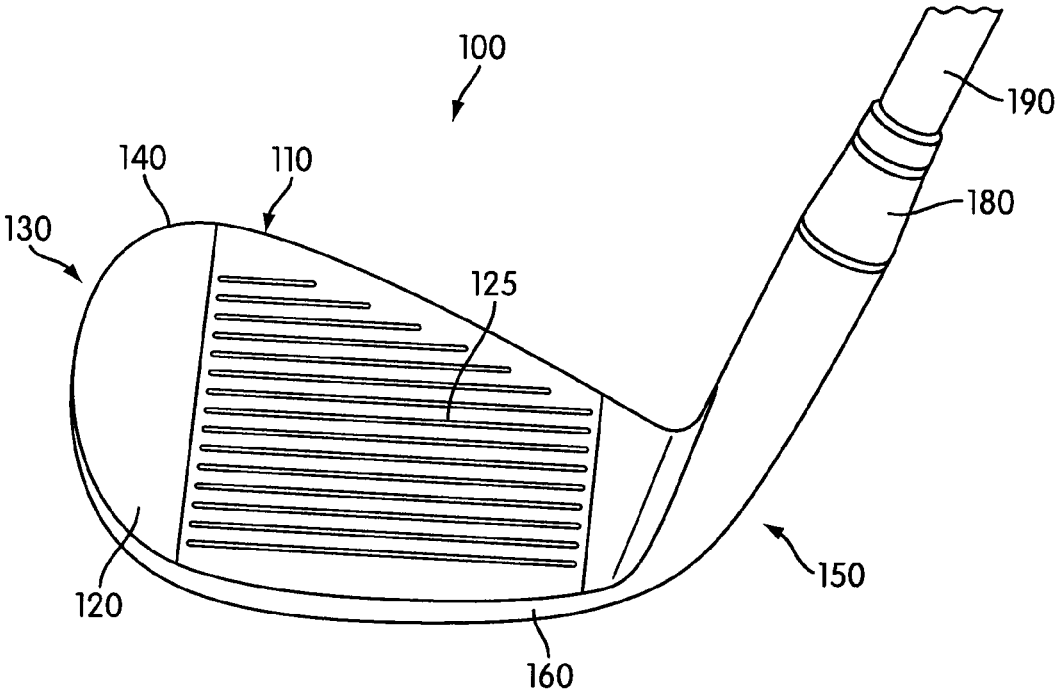
FIGS. 1A-1D are illustrative front, rear, heel end and toe end views respectively of a golf club head.
Figure 1B:
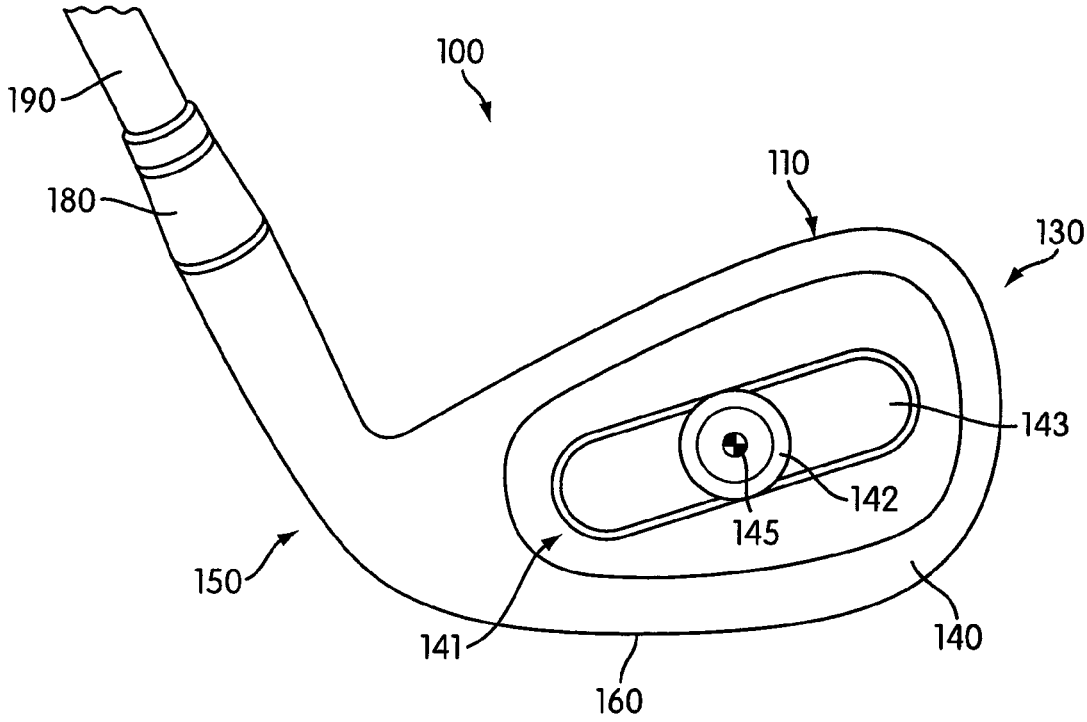
Figure 1C:
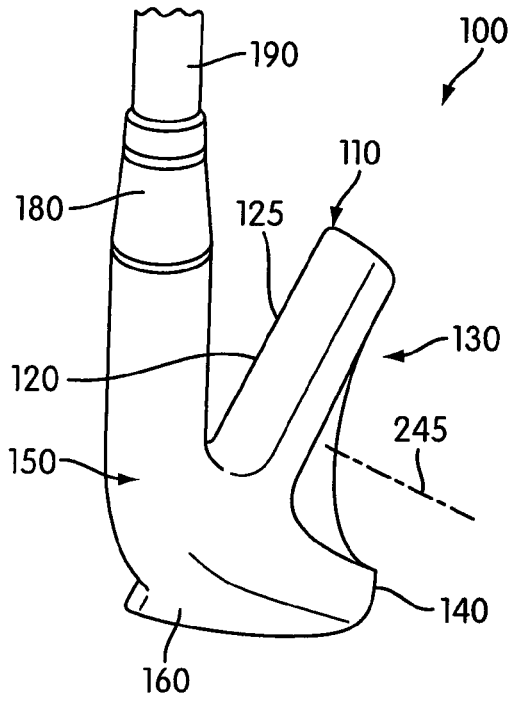
Figure 1D:
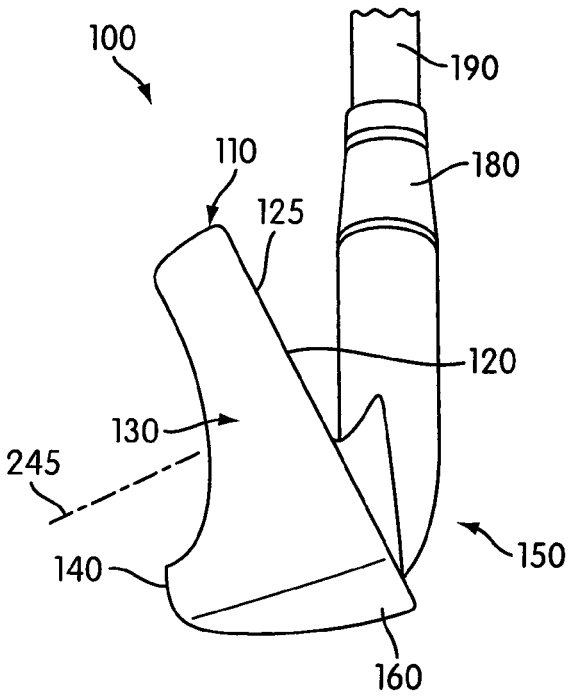

In the following description of the various embodiments, reference is made to the accompanying drawings that depict illustrative arrangements in which the invention may be practiced. It is understood that other embodiments may be utilized and modifications may be made without departing from the scope of the present invention. Additionally, various terms used herein are defined below.

Below several terms used throughout the remainder of the disclosure are illustratively described to facilitate clarity and understanding with respect to that described herein. The concept of center of gravity is well know and recognized by those skilled in the art. For example, center of gravity may be described as the point in or near a body at which the gravitational potential energy of the body is equal to that of a single particle of the same mass located at that point through which the resultant of the gravitational forces on the component particles of the body acts. Center of gravity may often be related to center of mass and they will be the same if they are being referred to or considered in an entirely uniform gravitational field. In practice, center of gravity and center of mass may be considered substantially the same when considering them in the substantially uniform gravitational field of the Earth. As such, description of characteristics, traits, effects and other details herein in reference to center of gravity may be considered to also apply to center of mass, given that the gravitational field is uniform.

Because various golf club heads and golf clubs are designed, shaped, sized and otherwise configured and formed to allow a golfer to hit a golf ball various distances, flight paths, and trajectories, the clubs may have a center of gravity in varied positions. Likewise, in certain configurations it may be desirable for the club to be configured such that movement of a feature or portion of the golf club head will cause the center of gravity of the golf club head to have a varied position with respect to the golf club head. In a set of golf clubs where each golf club head body has a different center of gravity, a structure that serves as an indicator of the location of this center of gravity also will be varied in position (and/or orientation) of club head body in order to reflect the different location of the center of gravity of each golf club head in the set. For example, because the center of gravity of a golf club head for a pitching wedge may be different than the center of gravity of a golf club head for a 5-iron, a center of gravity locator structure indicates a location which is different from the location indicated by a center of gravity location structure on the 5-iron.

According to some aspects of this disclosure, the golf club head including any center of gravity indicator mechanisms of "long" iron type golf clubs (i.e., irons with a relatively low degree of loft, e.g., a 3-iron) may be shaped to provide a center of gravity of the golf club head body which is closer to the heel of the club head body (i.e., near the hosel). Such a configuration decreases the distance from the hosel to the center of gravity of the golf club head body. Because the center of gravity is closer to the hosel, the golfer can more quickly and easily rotate the golf club head body (e.g., from an open club face position to a closed club face position). Hence, such a configuration can aid a golfer in imparting "draw" trajectory to the golf ball. A "draw" is a golf shot in which the golfer curves the ball in a direction opposite to the side from which it was struck. For example, for a right handed golfer, the golf ball will have "right to left" trajectory. The ball flight for a "draw" tends to have less back spin and, therefore, the ball tends to roll further once it lands. Also, "draws" tend to exhibit lower ball flights. These aspects of a "draw" (i.e., less back spin, further roll and lower ball flight) tend to increase the distance that the golf ball will travel upon being struck by the golfer. Therefore, providing the center of gravity of the golf club head body near the heel can increase the distance of a golf shot, which may be particularly useful in "long" irons.

According to some other aspects of this disclosure, the golf club head including any center of gravity indicator mechanisms of "short" iron type golf clubs (i.e., irons with a relatively high degree of loft, e.g., a 9-iron, wedges, etc.) may be shaped to provide a center of gravity of the golf club head which is closer to the toe of the club head. Such a configuration increases the distance from the hosel to the center of gravity of the golf club head. Because the center of gravity is further away from the hosel, the golfer may not be able to rotate the golf club head as quickly or easily (e.g., from an open club face position to a closed club face position). Therefore, the stability of the golf shot may be increased. Hence, such a configuration can aid a golfer in imparting "fade" trajectory to the golf ball. A "fade" is a golf shot in which the golfer curves the ball a direction corresponding to the side from which it was struck. For example, for a right handed golfer, the golf ball will have "left to right" trajectory. The ball flight for a "fade" tends to have more back spin and, therefore, the ball tends to roll less once it lands. Also, "fades" tend to exhibit higher ball flights. These aspects of a "fade" (i.e., more back spin, less roll and higher ball flight) tend to stop the ball from rolling. Therefore, providing the center of gravity of the golf club head near the toe can aid the golfer in stopping the ball from rolling when it lands on the green, which may be particularly useful in "short" irons.

According to some other aspects of this disclosure, the golf club head including any center of gravity indicator mechanisms of "middle" iron type golf clubs (i.e., irons with a relatively intermediate degree of loft, e.g., a 5-iron) may be shaped to provide the center of gravity of the golf club head generally near the center of the club head. Such a configuration can create a relatively intermediate distance from the hosel to the center of gravity of the golf club head. Because the center of gravity is at a relatively intermediate distance from the hosel (e.g., near the center of the golf club head body) the "middle" irons may have some characteristics from each of the above described "long" and "short" irons (e.g., further distance and better ball control), but not to the same extent.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; additional weight members; medallions; etc.

Still additional aspects of this disclosure relate to methods for producing iron-type golf club heads and iron-type golf club structures in accordance with examples of this disclosure. Such methods may include, for example, one or more of the following steps in any desired order and/or combinations: providing a golf club head body of the various types described above (including any or all of the various structures, features, and/or arrangements described above), e.g., by manufacturing or otherwise constructing the golf club head body, by obtaining the golf club head body from a third party source, etc.; engaging a shaft member with the golf club head body; and engaging a grip member with the shaft member.

Additionally, a golf club head that makes the location of its center of gravity visually apparent to the golfer will assist the golfer in performance as a result of preferred alignment, swing characteristics and related movement and use of the golf club and golf head. Certain structures and mechanisms housed on the golf club head may provide a visual indication of the location of the center of gravity of the golf club head body. These features may vary in shape, size, position, location, functionality, orientation, position and/or variability. Illustrative example of these features will be described below.

FIGS. 1A-1D are schematic front, rear, heel end, and toe end views, respectively, of an illustrative golf club head 100. As is apparent from the figures, a golf club head may illustratively be considered to include a top 110, a front 120, a toe end 130, a rear 140, a heel end 150 and a bottom (or sole) 160. Further, a golf club head 100 typically includes a hosel 180 formed to, among other things, facilitate connection of the golf club head 100 to the shaft 190. Hosel(s) 180 and shaft(s) 190 are well known in the art. Hosels 180 are commonly formed with the remainder of the golf club head 100 as a single body member.

Front surface 120 typically houses a hitting surface 125 configured for striking a golf ball. Hitting surface 125 may include any of a variety of features, configurations, shapes, surfaces and details. For example, hitting surface 125 may include a series of horizontal grooves that facilitate desired flight of the golf ball when the hitting surface 125 impacts a golf ball. Spacing, size, depth, shape, contour and orientation of these grooves may vary based on club type (and/or particular club manufacturer) to achieve a desired ball flight characteristic. Also, hitting surface 125 may be formed of a hardened material or may be treated to strengthen or harden the material in anticipation of the hitting surface repeatedly being used to impact the golf ball. Many other forms of surface treatments and ornamentation may be incorporated into the hitting surface 125, from hardened materials to holes, grooves, and corrugation and various other hitting surface materials, structures and configurations that are well known. The illustrative golf club head 100 illustratively shown in FIGS. 1A-1D may be commonly referred to as an "iron-type" golf club head. Iron-type golf heads may include various configurations and features. "Irons" as they may sometimes be called, may possess varied lofts attributed to the hitting surface 125 of the golf club head 100, various rear configurations or profiles such as blades, cavity backs, or honeycomb or other structural rear surfaces. Irons may also be formed from various materials, typically a metal. Depending on weighting, hardness and other desired characteristics, varied materials and configurations are available.

Shaft 190, as is also known in the art, may be varied in length, material composition, stiffness, flex and other traits and features. For example, flex and stiffness are among the illustrative characteristics that may be contemplated when selecting a particular shaft or shaft material as a preferred shaft stiffness may vary from golfer to golfer depending on skill, strength and swing characteristics including swing speed or swing path. In at least one categorization system, shafts may be categorized as Extra Stiff, Stiff, Regular, Senior and Ladies depending on the particular flex characteristics. Like other golf club features, the shaft 190 and grip 195 will often be selected based upon golfer "feel" as well as traits relating to the golfers physical make-up and swing characteristics and tendencies.

The shaft 190 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip 195 may be attached to, engaged with, and/or extend from the shaft 190 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip may be integrally formed as a unitary, one-piece construction with the shaft 190. Additionally, any desired grip materials may be used without departing from this disclosure, including, for example: rubber materials, leather materials, rubber or other materials including cord or other fabric material embedded therein, polymeric materials, and the like.

Figure 2:
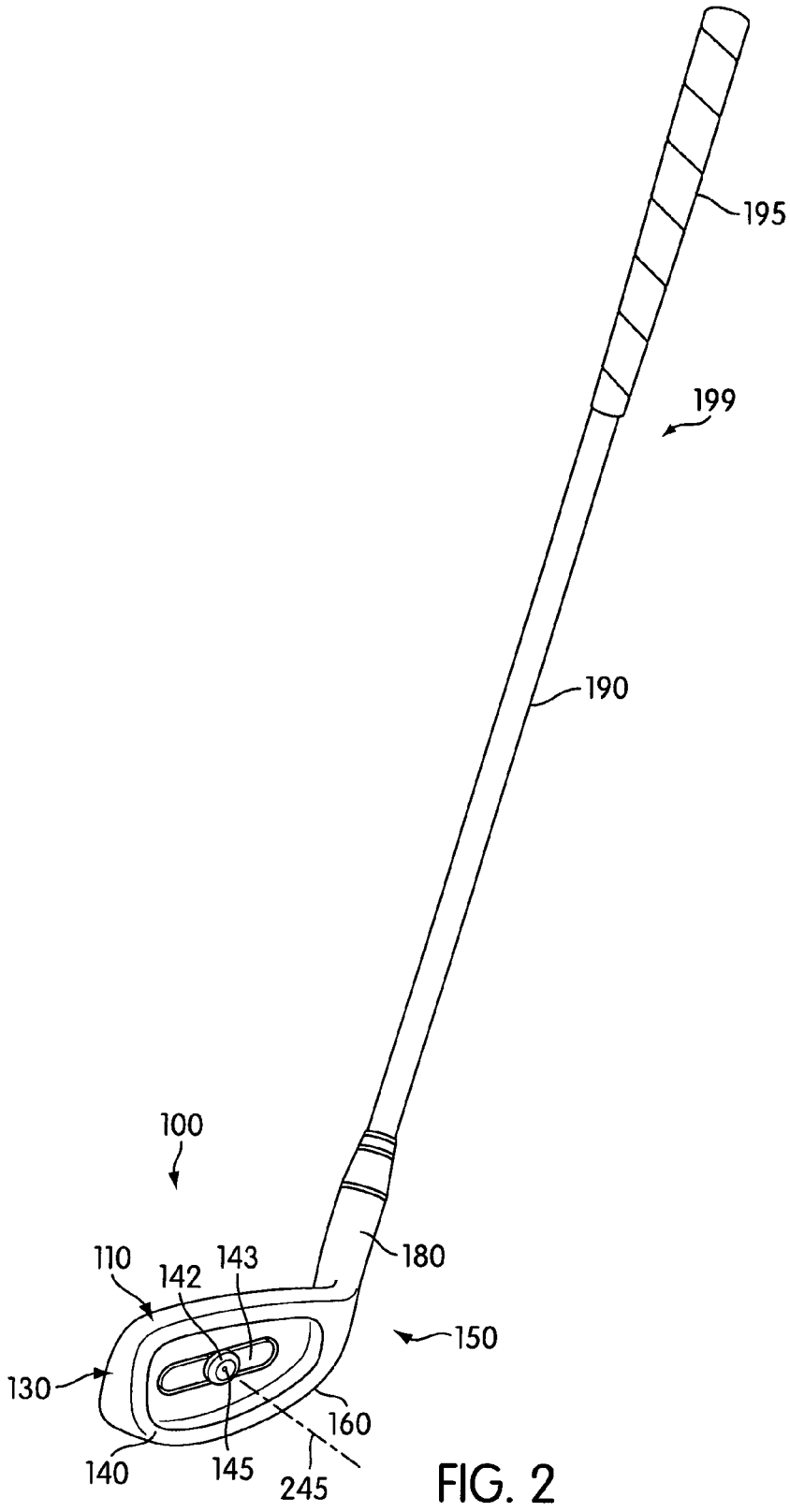
FIG. 2 is an illustrative rear view of a golf club with a golf club head similar to the golf club head of FIGS. 1A-1D.

The shaft 190 may be received in, engaged with, and/or attached to the club head 100 in any suitable or desired manner, including in conventional manners known and used in the art, without departing from the disclosure. In its usable form, the shaft 190 may be engaged with the golf club head 100 via a hosel 180 and/or directly to the club head structure, e.g., via adhesives, cements, welding, soldering, mechanical connectors (such as threads, retaining elements, or the like), etc.; through a shaft-receiving sleeve or element extending into the golf club head 100; etc. If desired, the shaft 190 may be connected to the head in a releasable manner using mechanical connectors to allow easy interchange of one shaft for another on the head. The golf club 199 illustratively depicted in FIG. 2 is formed by a shaft 190 housing a grip 195 at one end being coupled to a golf club head 100 similar to shown in FIGS. 1A-1D. However, as is apparent, the golf club head shown in FIG. 2 is a left handed golf club head 100 while the golf club head of FIGS. 1A-1D is right-handed golf club head. As such, it should be recognized that the features, structures and mechanisms described herein are easily adaptable for both right and left handed golfers and golf clubs.

Figure 3A:
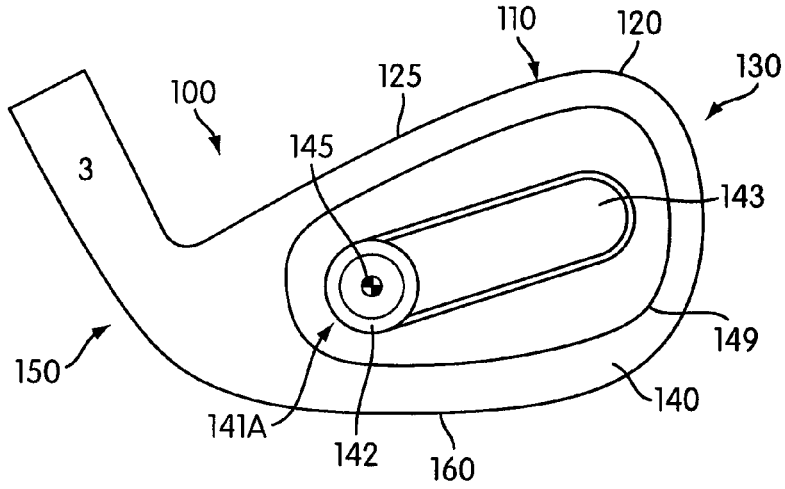
FIGS. 3A-3C are illustrative rear views of golf club heads with center of gravity indicator mechanisms.
Figure 3B:
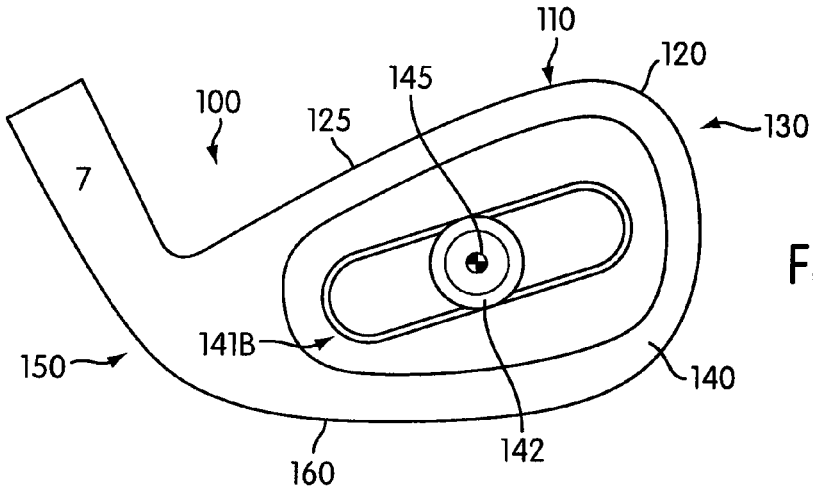
Figure 3C:
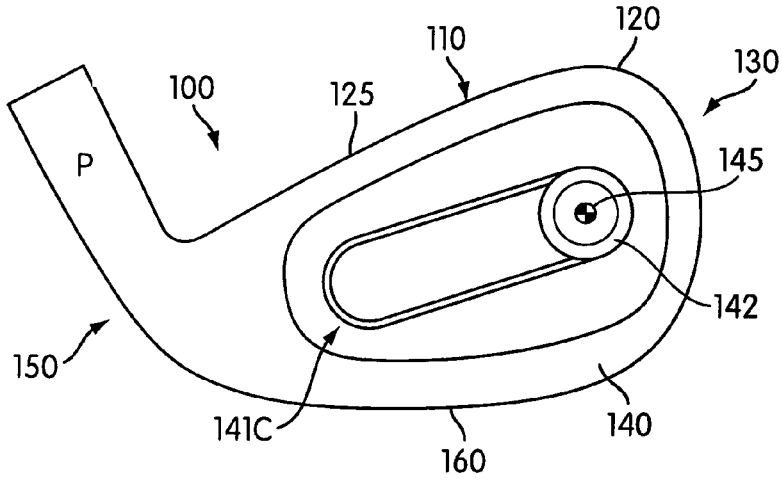

FIGS. 3A-3C are illustrative rear views of golf club heads with center of gravity indicator mechanisms 141. More specifically, in FIGS. 3A-3C an illustrative 3-iron (labeled with a "3"), 7-iron (labeled with a "7") and pitching wedge (labeled with a "P") are shown. Each of the golf club heads 100 of FIGS. 3A-3C respectively house a center of gravity indicator mechanism 141A-C that each include a center of gravity locator structure 142, and here, a latitudinal strip 143. Each of the golf club heads shown in FIGS. 3A-3C also each have center of gravity 145 illustratively depicted with the cross-hatched circular region. Consistent with that described above relating to the long, middle and short irons, the center of gravity is located in varied positions to achieve varied shot distance, varied ball flight paths and varied spin, among other characteristics. Again, as is apparent from FIGS. 3A-3C, a long iron type golf club head is formed such that the center of gravity 145 is located generally more towards the heel end 150 and bottom (or sole) 160 as compared to the middle and short irons. In contrast, the center of gravity 145 of the short irons is located more towards the toe end 130 of the golf club head 100 as compared to the long and middle irons. Lastly, the center of gravity of the middle irons falls in-between these regions.

Figure 4:
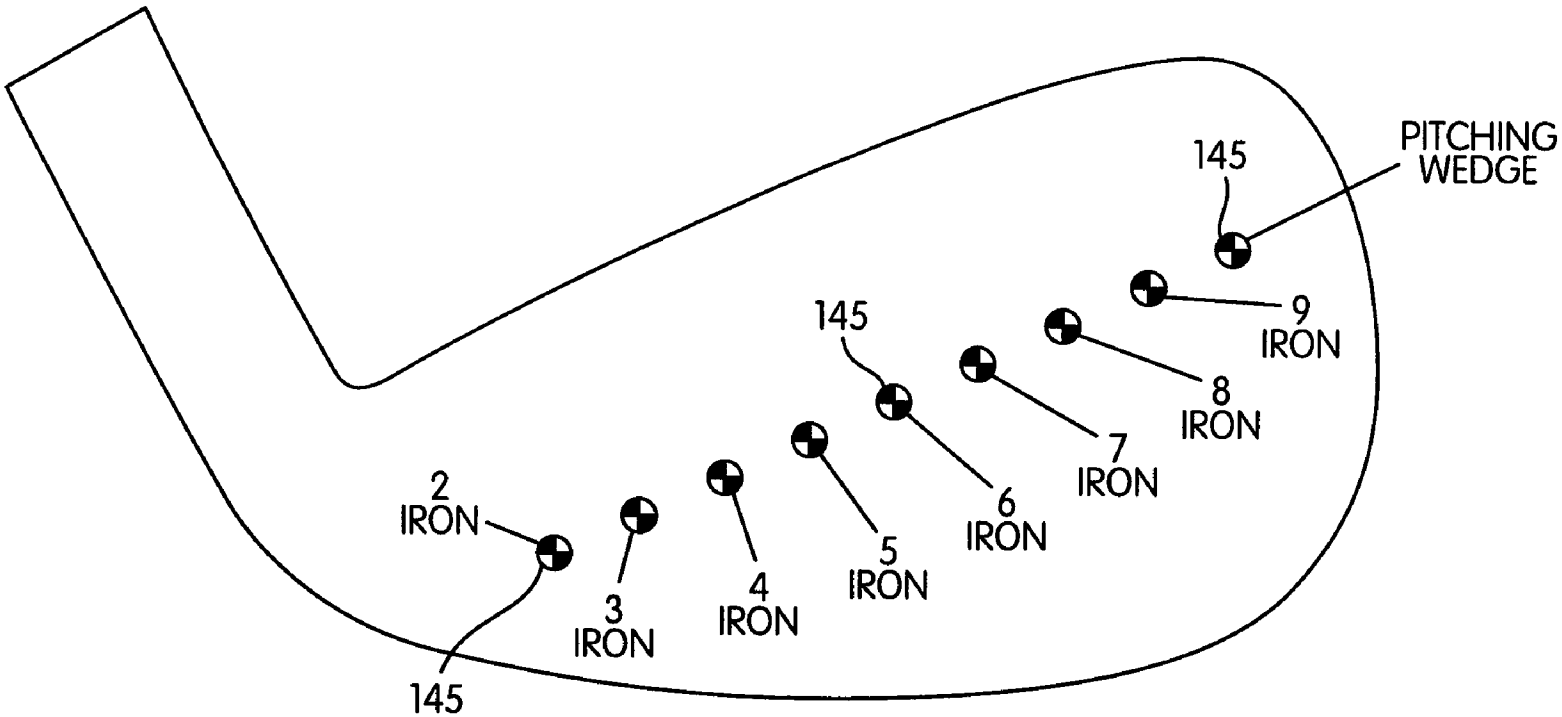
FIG. 4 is a rear view illustrative schematic diagram of varied positions of the center of gravity for various golf club heads in a set of clubs.

FIG. 4 is a rear view illustrative schematic diagram of varied positions of the center of gravity for various golf club heads in an embodiment of a set of traditionally labeled iron-type golf club heads (3-iron through pitching wedge). However, golf club sets are well known to include other clubs including irons such as 1-irons, lob wedges, sand wedges, etc. In this set, the center of gravities 145 of the various irons vary from the most heel end and bottom location of the center of gravity of the 3-iron to the most toe end and top location of the pitching wedge. In this set the centers of gravity vary or trend in a linear fashion as shown and described.

Returning to FIGS. 3A-3C, each of the varied golf club heads shown (3, 7, P) have a distinct center of gravity indicator mechanism 141A-C. Generally, the center of gravity indicator mechanisms 141A-C each has a latitudinal strip 143 with a center of gravity locator structure 142 positioned within the latitudinal strip. As shown, in each of the arrangements the latitudinal strip 143 is shown as having a generally pill or ovular shape with curved ends. Additionally, the latitudinal strip 143 runs primarily in a latitudinal direction, but also possesses a somewhat upward sloping direction in its orientation on the rear or rear face of the golf club head. Still, it may be properly characterized as latitudinal. As used herein, a latitudinal strip is a strip with its largest dimension running primarily in a horizontal or left and right direction relative to the ground as is illustratively depicted and described herein. The latitudinal strip 143 may be oriented at any of a number of angles relative to the golf club head and to the ground when the golf club head is placed in an addressing position near a golf ball during typical use by a golfer. Additionally, in some of the arrangements shown, the latitudinal strip 143 may be characterized as running parallel or substantially parallel (e.g., appears parallel to a user or observer viewing) to the top surface of the golf club head. Even further, when comparing the latitudinal strip of each of FIGS. 3A-3B to the progression of center of gravities shown in FIG. 4, the latitudinal strip runs parallel to this progression. Even further, the progression of center of gravities each, if transposed on to the rear 140 of the golf club heads 100 of FIGS. 3A-3C, the center of gravities would all be located within the latitudinal strip.

The center of gravity locator structure 142 in each of the arrangements of FIGS. 3A-3C may be described as circular or disk shape. Also, the center of gravity locator structure 142 is housed and configured such that the center of gravity 145 for that given club arrangement runs through the center of the circular or disk shaped center of gravity locator structure 142. The golf club head 100, being a three-dimensional body, has a center of gravity located at a position with three-dimensional coordinates/location. Accordingly, the cross-hatched region demonstrating the center of gravity 145 throughout the disclosure (both above and below) illustratively shows a point on an axis that runs through the center of gravity of the golf club head transverse to the rear 140 of the golf club head. In many instances the center of gravity of a three-dimensional body is located within or in an internal portion of the body (e.g. a golf club head) such that its location is not visible externally. The center of gravity locator structure 142 housed on the rear surface is visible externally and is configured to provide a visual cue or indicator to the golfer as to the location of the center of gravity of the golf club head 100. In doing so, the golfer is able to better understand with each particular golf club in a set of golf clubs how the ball will be struck and the anticipated effects on the ball's trajectory, distance, spin, etc. Additionally, the golfer can also align the golf club 199, especially the golf club head 100 in an addressing position, such that the backswing and downswing of the golf club 199 will result in the front 120 including the hitting surface 125 striking the ball in a proper and desired position and orientation to obtain a desired result.

Figure 12:
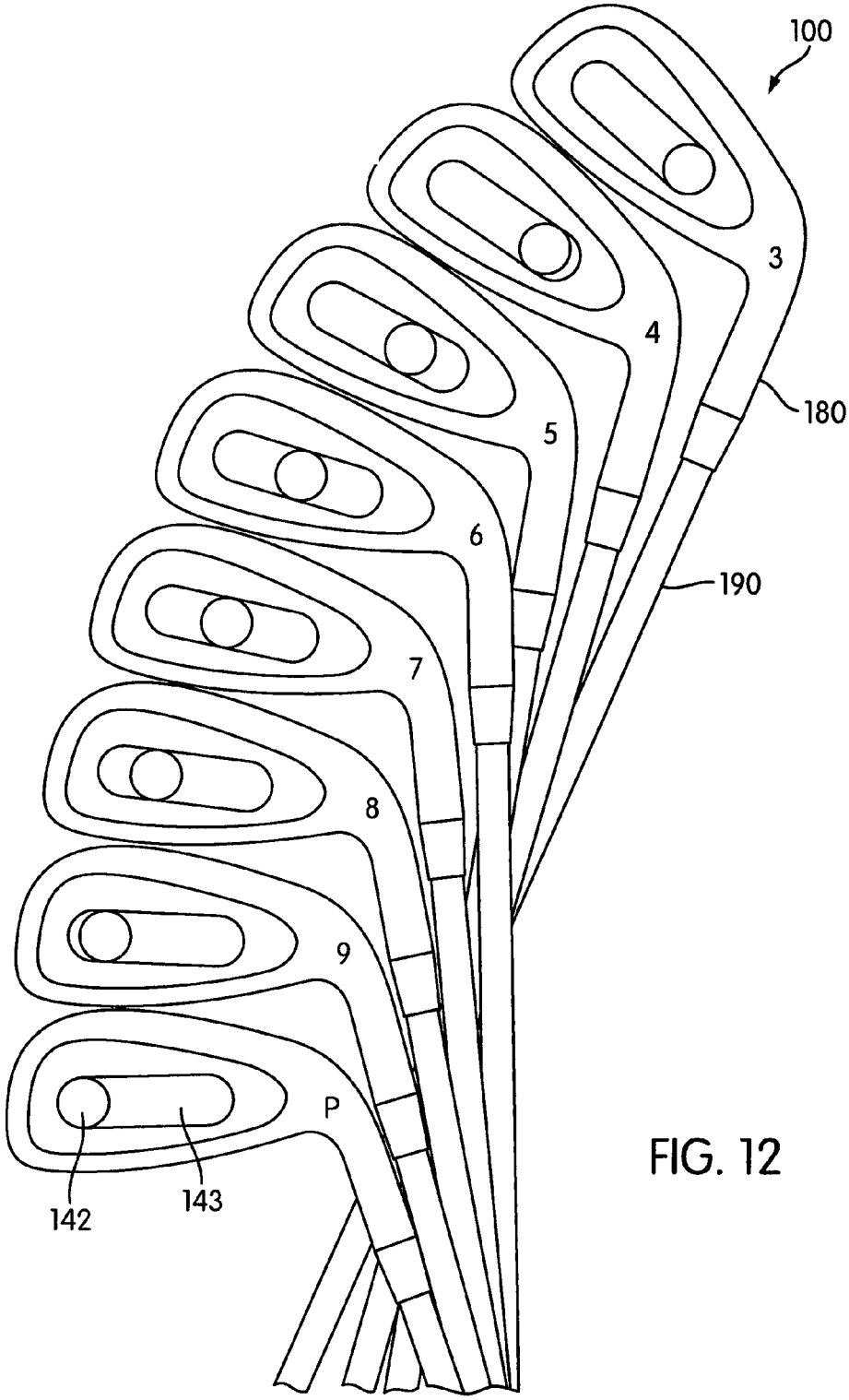
FIG. 12 is an illustrative rear view of a set of golf clubs.

Further, to facilitate the golfer in having a visual indicator or cue, as demonstrated by the arrangement of FIGS. 3A-3C, the center of gravity indicator mechanisms 141A-C may be substantially the same except for the location of the center of gravity locator structure 142 relative to the latitudinal strip 143 and/or relative to the remainder of the golf club head 100. While only a 3-iron, 7-iron and a pitching wedge are shown in FIGS. 3A-3C, one skilled in the art will recognize based upon that shown and described herein that the remainder of the golf clubs in a golf club set may also include a center of gravity indicator mechanism 141 similar to those depicted in FIGS. 3A-3C, except for they may have a varied center of gravity locator structure arranged, orientated and/or positioned consistent with the center of gravity 145 as shown in the schematic diagram of FIG. 4. FIG. 12 illustratively depicts one arrangement of such a set of golf club heads.

Further, FIGS. 3A-3C illustratively show several selected club heads from a set of golf clubs in which each golf club has a distinct center of gravity indicator mechanism 141 that is distinct from those of the other golf club heads 100 in the set primarily in that the center of gravity locator structure 142 is housed within the latitudinal strip 143 but in a distinct position for each golf club head 100 in the set and also in varied positions tied to the location of the center of gravity for each type (e.g. number/loft) of the golf club. As such, a set of golf club heads (and golf clubs) is formed with a consistent center of gravity indicator mechanism 141 with a consistent latitudinal strip 145 that houses and contains a center of gravity locator structure 142 that has a varied position on each golf club head 100. While the position of the center of gravity locator structure 142 varies from golf club head to golf club head within the described set of golf clubs, the center of gravity locator structure 142 and center of gravity indicator mechanism 141A-C as shown in FIGS. 3A-3C are properly characterized as "fixed" rather than a "variable" arrangement in which one club may be modified to have a center of gravity 145 that is distinct depending on movement of the center of gravity locator structure 142. Accordingly, these fixed center of gravity indicator mechanisms 141 are typically formed during production molding, forging, or casting of the golf club head or constructed in other fashion at the time of original assembly as is known in the art.

In contrast to the "fixed" center of gravity indicator mechanisms 141 described above with respect to FIGS. 3A-3C, FIGS. 5A-9C illustratively demonstrate variable center of gravity indicator mechanisms 541. It should be noted and understood that it is contemplated that the features, characteristics and workings of "fixed" center of gravity indicator mechanisms 141 may be utilized in and incorporated into to the variable center of gravity indicator mechanisms 541 with the main distinction between fixed and variable being that described with the respect to the movement capabilities of the "variable" center of gravity locator structure 541. The reverse is also true.

Figure 5A:
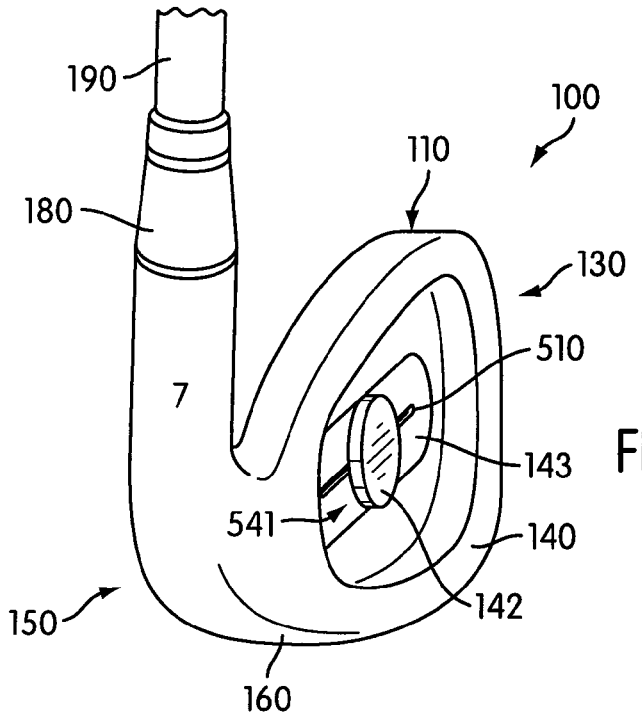
FIGS. 5A-5B are illustrative perspective heel end view of various golf club heads with variable center of gravity indicator mechanisms.
Figure 5B:
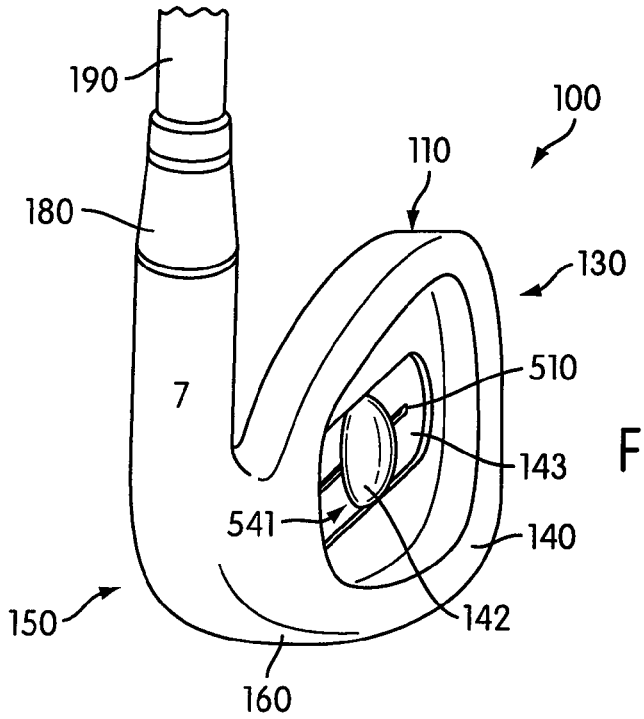

FIGS. 5A-5B are illustrative perspective heel end views of various golf club heads with variable center of gravity indicator mechanisms. Here, two arrangements of variable center of gravity indicator mechanism 541 are shown in which a track 510 is housed within the center of the latitudinal strip. The track 510 runs parallel to the length of the latitudinal strip 143 and may be formed of any of numerous known track type configurations to allow the center of gravity locator structure 142 to be variably moved through guided translation along the rear 140 of the golf club head. The follower member (not shown in FIGS. 5A-5B), complementary in shape to the track 510, may run through the track 510 as shown later. Additionally, the center of gravity locator structure 142 may be moveably housed on the track 510 and rear 140 of the golf club heads such that the center of gravity locator structure is attached via a resistive connection in which a sufficient external force must be applied to the center of gravity locator structure to move the center of gravity locator structure 142 relative to the golf club head 100. This resistive connection may prevent the center of gravity locator structure from moving inadvertently when the golf club head 100 is moved through a swing path during use of the golf club.

Figure 6:
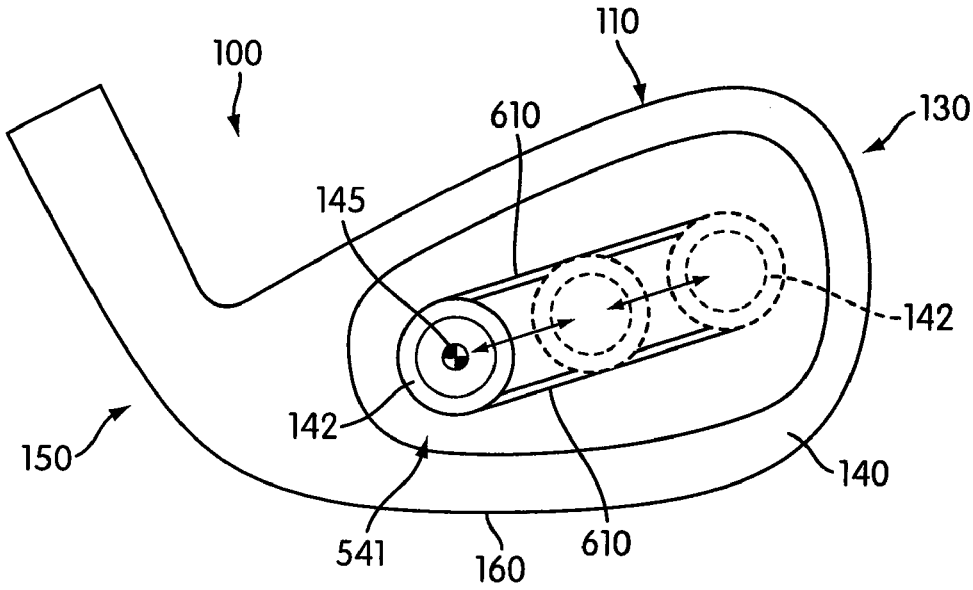
FIG. 6 is an illustrative rear view of a golf club head with a variable center of gravity indicator mechanism.

The center of gravity locator structure 142 may have various configurations and characteristics consistent with that described herein. For example, in one configuration the center of gravity locator structure 142 may be coin shaped (FIG. 5A). In another illustrative configuration, the center of gravity locator structure may fit flush with the rear 140. In yet another illustrative configuration, the center of gravity locator structure 142 may have a bulbous or dome shape (FIG. 5B). The center of gravity locator structure 142 may also have a varied profile as far as height or thickness moving from its center outward or vice versa. Additionally, in certain arrangements the center of gravity locator structure may be formed and positioned such that as the center of gravity locator structure 142 is moved along the rear 140 of the golf club head 100, the golf club head center of gravity will also be modified. Accordingly, the center of gravity of the golf club 100 may be varied such that the center of gravity 145 remains on axis transverse to the rear 140 of the golf club head and through the center of the center of gravity locator structure 142 as demonstrated with center of gravity 145. Alternatively, because movement of a certain portion (center of gravity locator structure 142) of the mass (or weight) of the golf club head may only gradually vary the relocation of the center of gravity, the location of the center of gravity locator structure 142 may not continually be tied to the location of the center of gravity in a one-to-one relationship in that movement of the center of gravity locator structure 142 a certain distance in a certain linear direction may cause the center of gravity to be moved less than that certain distance or in a slightly varied distance. FIG. 6 illustratively demonstrates the linear translation and back and forth movement of the center of gravity locator structure 142 of a variable center of gravity indicator mechanism 541. Here, the broken line or phantom showing of the center of gravity locator structure 142 within the latitudinal strip demonstrates various potential locations of the center of gravity locator structure 142 in various positions depending on where the user or golfer wishes the structure to be positioned. As such, a single club is provided with further adjustability in allowing the golfer and other users the ability to adjust the location of the center of gravity 145 of the golf club head. Additionally, the center of gravity locator mechanism in an embodiment in which the golf club head is configured and weighted such that for all the various positions of the center of gravity locator structure 142, the center of gravity will remain on an axis transverse to the rear 140 of the golf club head that runs through the center 145 of the center of gravity locator structure. Additionally, in certain embodiments rather than remaining consistently at the center of the center of gravity locator structure 142, the center of gravity of the golf club head may be located on the axis transverse to the rear 140 of the golf club head 100. The axis may run through varied askew portions of the center of gravity locator structure 142 depending on the location or position of the center of gravity locator structure in the variable center of gravity indicator mechanism 541. In such a configuration, the area formed by the top of the center of gravity locator structure 142 will provide sufficient area such that while the axis transverse to the rear 140 of the golf club head and running through the center of gravity 145 does not always align in the center of the center of gravity locator structure 142, it still intersects the center of gravity locator structure 142 within its perimeter. As such, the center of gravity locator structure 142 successfully provides visual assistance to a golfer but in a varied fashion such that when the golfer varies the location of the center of gravity by moving the center of gravity locator structure 142, the golfer can still be aware of where that center of gravity has been repositioned.

Figure 7A:
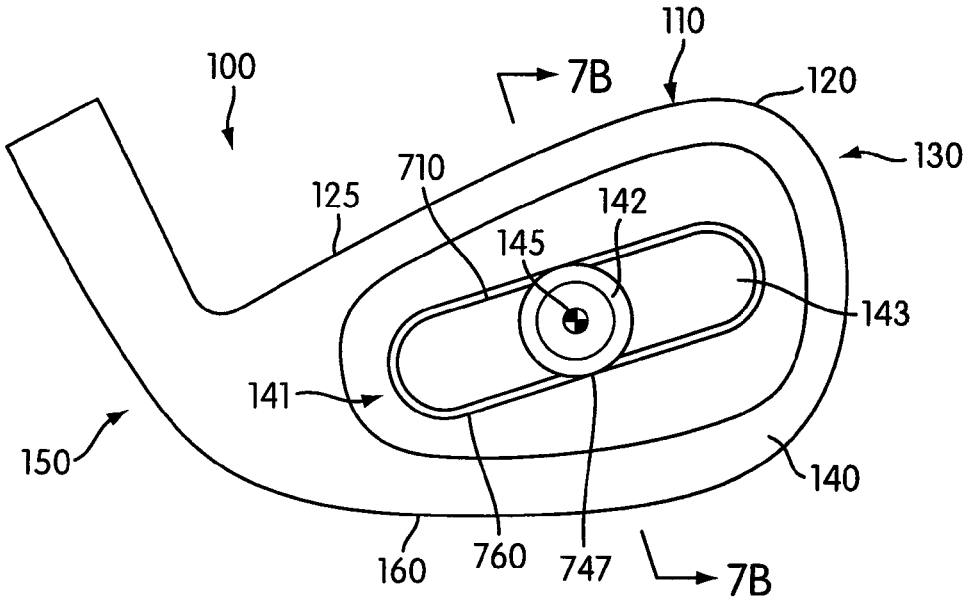
FIGS. 7A-7B are illustrative rear and heel end cross-sectional views, respectively, of a golf club head with a variable center of gravity indicator mechanism.
Figure 7B:
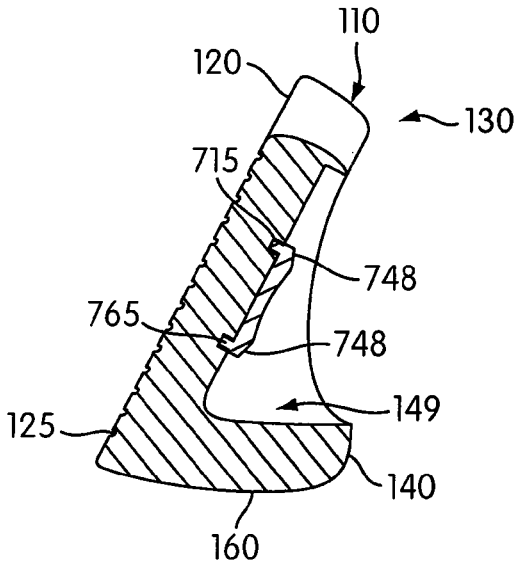

FIGS. 7A-7B are illustrative rear and heel end cross-sectional views respectively of a golf club head with a variable center of gravity indicator mechanism. In the arrangement of FIGS. 7A-7B the variable center of gravity locator structure 142 is slidably coupled to latitudinal strip 143 on the rear surface 140 of the golf club head. More particularly, portions of the outer edge of the center of gravity locator structure 142 here are slidably coupled to latitudinal strip 143 to facilitate back and forth movement across the rear 140 of the golf club head 100 depending on golfer preferences. Here, the top edge 710 and bottom edge 760 of the latitudinal strip 143 are configured to house the outer edge 747 of the center of gravity locator structure 142. As is apparent in FIG. 7B, in one arrangement, a follower member 748 housed on the outer edge 747 of the center of gravity locator structure 142 may be formed with a complementary shape to the top and bottom tracks or cut-outs 715, 765 of latitudinal strip 143 so as to allow for guided translation of the center of gravity locator structure 142 in a path aligned with the longitudinal strip so as to permit a golfer to move or otherwise vary the location of the center of gravity 145 as a result of movement of the center of gravity locator structure 142. While the follower members 748 and complimentary cut-outs 715, 765 are oriented in FIGS. 7A-7B such that the follower members 748 extend into the golf club head 100 in a direction towards the front 120 or face of the golf club head, other configurations are contemplated and may be utilized. For example, while not specifically shown, the followers 748 may also extend in opposing directions toward the top 110 and bottom 160 and be somewhat parallel to the rear 140 of the golf club head. Accordingly, the cut-out may be a lip in the rear 140 of the golf club head outside of the outer edge 747 of the center of gravity locator structure 142 and may be described as being grooves cut into a side wall of the rear 140 of the golf head 100. As such, the followers 748 each may be respectively housed in a "sandwiched fashion" between regions of internal material of the golf club head 100 but still permitting translation back and forth in the direction of the length of the latitudinal strip 143 as they would slide in the groove, track or cut-out 715, 765. Accordingly, the center of gravity locator structure 142 can be held to the rear 140 of the golf club head 100 while still being allowed to move.

Figure 8A:
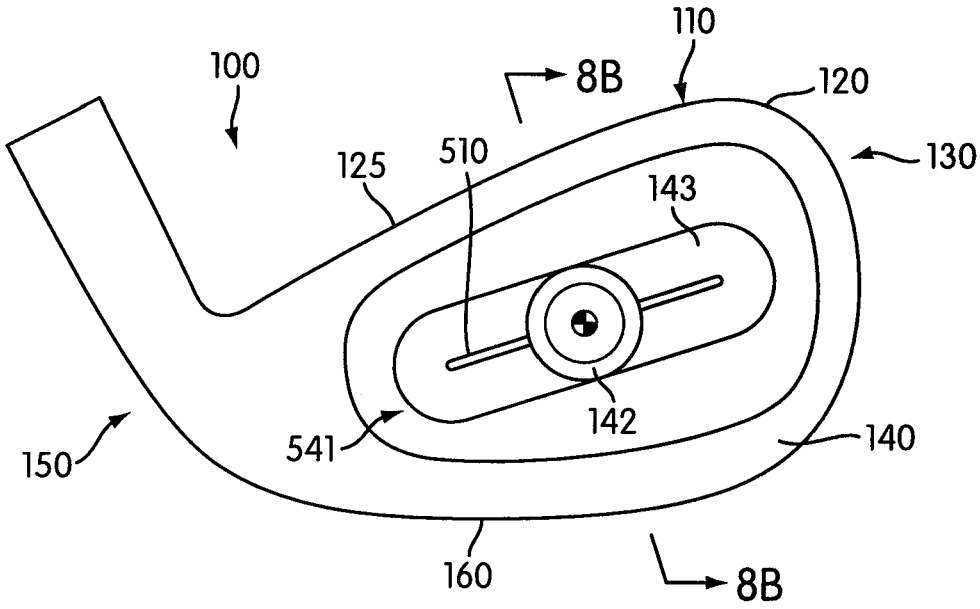
FIGS. 8A-8B are illustrative rear and heel end cross-sectional views, respectively, of another arrangement of a golf club head with a variable center of gravity indicator mechanism.
Figure 8B:
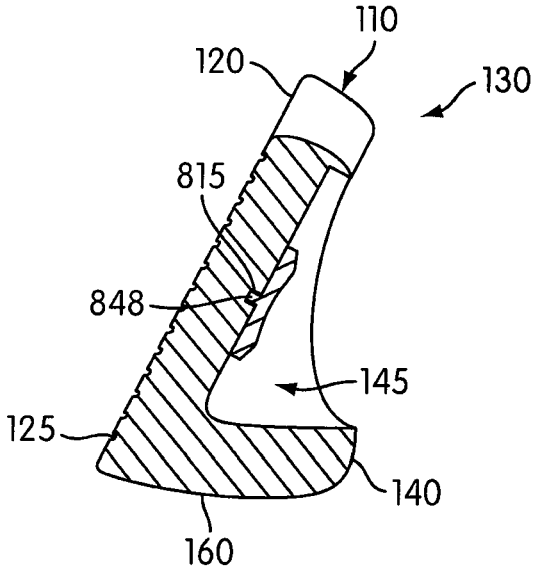

Similar to the configuration illustratively shown in FIGS. 7A-7B with dual track and follower members, FIGS. 8A-8B are illustrative rear and heel end cross-sectional views respectively of another embodiment of a golf club head 100 with a variable center of gravity indicator mechanism 541. In this particular configuration, rather than the center of gravity locator structure 142 being coupled to the rear 140 of the golf club head 100 and to the latitudinal strip 143 at its outer edges, a single follower member 848 is configured and coupled to run along a single track or cut-out 815 centrally housed within the latitudinal strip 143. Here, just as in the arrangement of FIGS. 7A-7B, the particular shape, size and other features of the center of gravity locator structure 142 and latitudinal, strip 143 may take on a variety of characteristics as will be described further below.

Figure 9A:
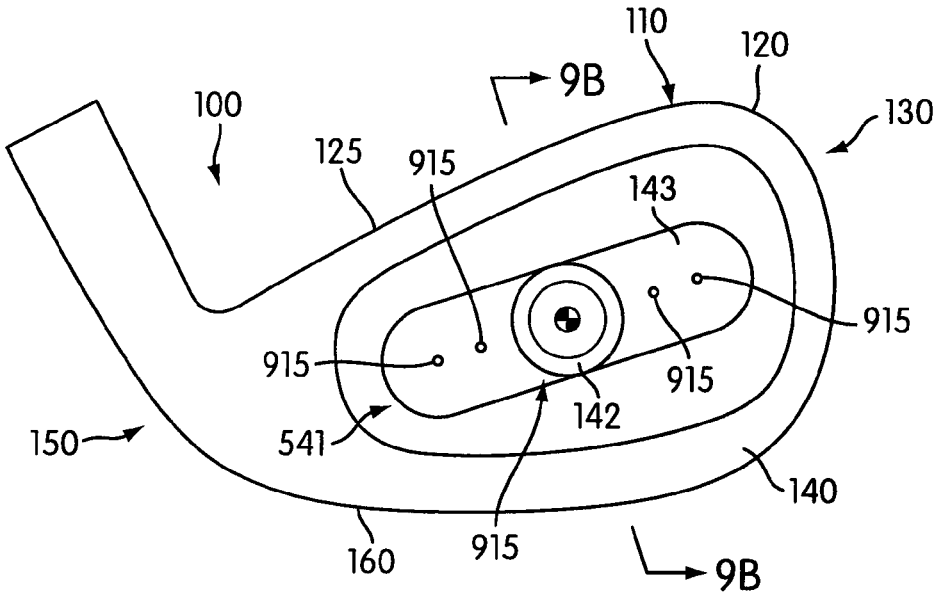
FIGS. 9A-9B are illustrative rear and heel end cross-sectional views, respectively, of yet another arrangement of a golf club head with a variable center of gravity indicator mechanism.
Figure 9B:
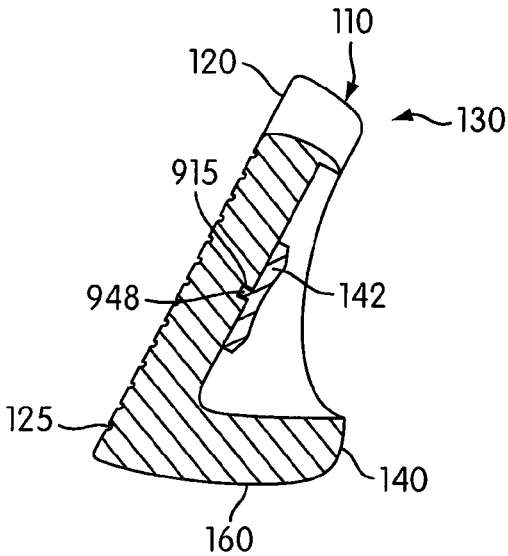

Another further arrangement of a golf club head with a center of gravity indicator mechanism 141 is illustratively shown in FIGS. 9A-9B. Here, rather than the center of gravity locator structure 142 being configured as a slidable mechanism which is slid into various positions within the latitudinal strip 143 on the rear 140 of the golf club head 100, the rear surface 140 of the golf club head 100 includes several center of gravity locator structure 142 attachment holes 915 sized and arranged to received an attachment member 948 protruding from and housed on a bottom of the center of gravity locator structure 142. In this arrangement, the center of gravity locator structure may be coupled to the rear of the golf club head by snapping the center of gravity locator structure onto the rear surface of the golf club head by applying a force to the center of gravity locator structure such that the attachment member 948 is forced into one of the center of gravity locator structure attachment hole 915 positioned within latitudinal strip 143. In this configuration, the location of the center of gravity 145 of a single club may be varied by quickly and easily un-snapping and then re-snapping the center of gravity locator structure 142 in a distinct location. Since the golf club head 100 and the center of gravity locator structure are configured and weighted such that this relocation of the center of gravity locator structure 142 causes the center of gravity 145 of the entire golf club head 100 to be moved accordingly, the golf club head 100 is variable in rapid and simple fashion while still providing a golfer a visual indicator as to the location of the center of gravity as a result of the center of gravity locator structure 142.

Features of the latitudinal strip 143 and the center of gravity locator 142 as have been shown throughout the disclosure may among other things provide improved alignment and visual indication to a golfer accordingly assisting the golfer in hitting golf shots. More particularly, knowing the location of the center of gravity 145 (e.g. the height off the bottom of the club and the position on the club such as towards the toe end or towards the heel end) allows the golfer to better understand how the golfer's swing and the contact of the hitting surface will cause the ball to travel. Because the position of the center of gravity relative to the ball at a point of impact as well as during the swing will affect the distance, trajectory and/or spin of the ball in the resulting golf shot as described above, configuration of the above described features may be varied and utilized to accomplish certain golf shot characteristics.

Figure 10A:
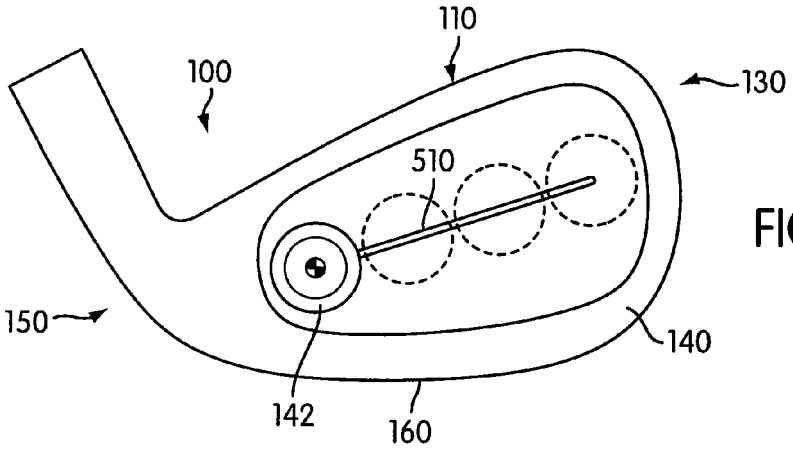
FIGS. 10A-10C are illustrative rear views of golf club heads with center of gravity indicator mechanisms.
Figure 10B:
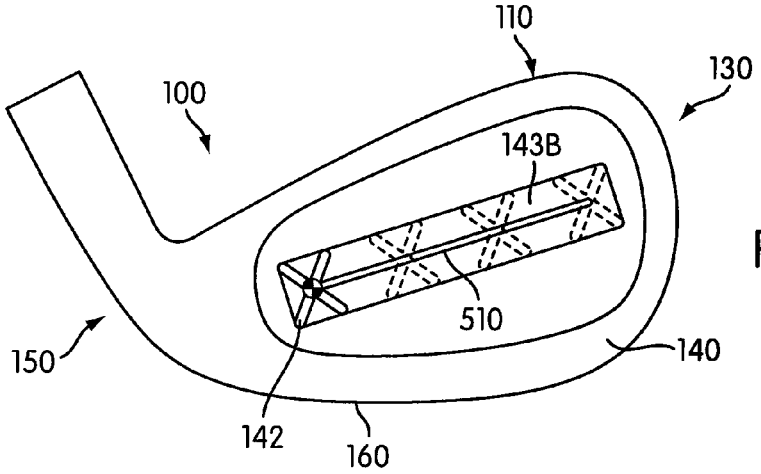
Figure 10C:
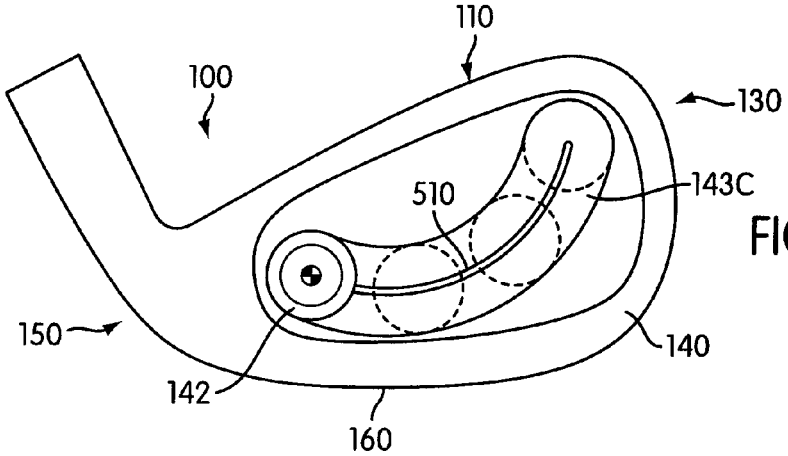

FIGS. 10A-10C are illustrative rear views of golf club heads with center of gravity indicator mechanisms. As is apparent from the figures, in certain arrangements, such as those shown in FIGS. 10B and 10C, the latitudinal strip may possess any of a variety of shapes or configurations to facilitate the visual indication of the center gravity as well as to facilitate variability of the location of the center of gravity. For example, in FIG. 10B, a rectangular shaped latitudinal strip 143B may used with an X-shaped center of gravity locator 142 to provide an enhanced visual indicator to the golfer to facilitate alignment and swing of the golfer using the golf club. Additionally, the X-shape of the center of gravity locator structure 142, while providing an enhanced visual impression for alignment purposes, also allows weighting of the center of gravity locator structure 142 so that the center of gravity locator structure is better able to correlate to the positioning of the center of gravity 145 as it is moved back and forth through the path within the latitudinal strip 143. For example, various branches of the "X" could be made of different material with different weights. Additionally, the latitudinal strip may be formed in a variety of shapes and contours. As is apparent from FIG. 10C, the latitudinal strip 143 may be formed in a curved or "banana shape" with the center of gravity locator structure 142 being variably housed with in the latitudinal strip 143. Additionally, the latitudinal strip 143 may be hollowed out or cavity shaped with a variety of contours including a flat rectangular cavity, a "half-pipe", or a raised strip. These particular shapes and configurations are illustratively provided and various shapes and configurations are contemplated consistent with that described. Accordingly, the latitudinal strip 143 may be selectively shaped and tailored for golfers of particular swings. For example, a golfer with a tendency to hit drastic "slices" throughout a club set may need or desire a golf club head 100 with a center of gravity indicator mechanism 141 on each of the golf club differently as compared to a professional or low handicap golfer as these different types of golfers may need golf club heads with different center of gravity placement to optimize their particular swing performance. Likewise, a golf club head or set of golf club heads may have these described features shaped and formed to enhance or facilitate shot shaping or even trick shot capabilities that may include backspin or significant fades or slices as may be desirable in rescue club or other specialty clubs.

As is apparent from FIGS. 10B-C, as well as the other figures of the disclosure, the shape, size, orientation, position and/or configuration of the latitudinal strip 143 further contribute alone, and in combination with, the center of gravity locator structure 142 as a visual indicator to assist the golfer in utilizing the golf club. For example in some configurations shown, the latitudinal strip 143 generally runs parallel with the top surface 110 of the golf club head and the center of gravity locator structure 142, whether fixed such that the center of gravity is moved position-wise through out the set or variable in which the position may be varied on a single club head, also moves/shifts through that same alignment. Accordingly, because the center of gravity locator structure 142 varies in position within the latitudinal strip 143 through the set of clubs or the like, the latitudinal strip 143 may provide a fixed reference background thereby enhancing the visual impression of the center of gravity locator structure 142 in its varied positions on either a single club or as being varied throughout the set. Also, the center of gravity indicator mechanism 141 may also be configured without a latitudinal strip with the center of gravity locator structure 142 being coupled as described herein but to a traditional rear 140 of a golf club head or the like as shown in FIG. 10A.

In each of the golf club heads with variable center of gravity indicator mechanisms 541, e.g. the arrangements of FIGS. 5A-10C, the center of gravity locator structure 142 may be moveably coupled consistent with that shown by a resistive connection. In such a resistive connection configuration in which a single track and follower structure or a pair of track and follower structures, or similar arrangements are configured such that in order to cause the center of gravity locator structure 142 to be moved, an external force needs to be applied. Further, sufficient force needs to be applied as the resistive connection is configured such that a de minimis or incidental force will not cause the center of gravity locator structure to be moved from its present location relative to the rear 140 of the golf club head. As such, the swing of the golf club will not typically cause the center of gravity locator structure 142 to incidentally be moved to an improper position. The resistive connection may be accomplished in any of a number of configurations known in the art. The track and follower configurations previously shown and described may be sized and shaped to fit snuggly such that they are frictionally engaged and require a minimum threshold external force to cause movement. Additionally, other sliding and rotation mechanisms that increase the friction between two structures moving relative to one another of virtually any type as are known in the art may be utilized consistent with that described herein.

Figure 11A:
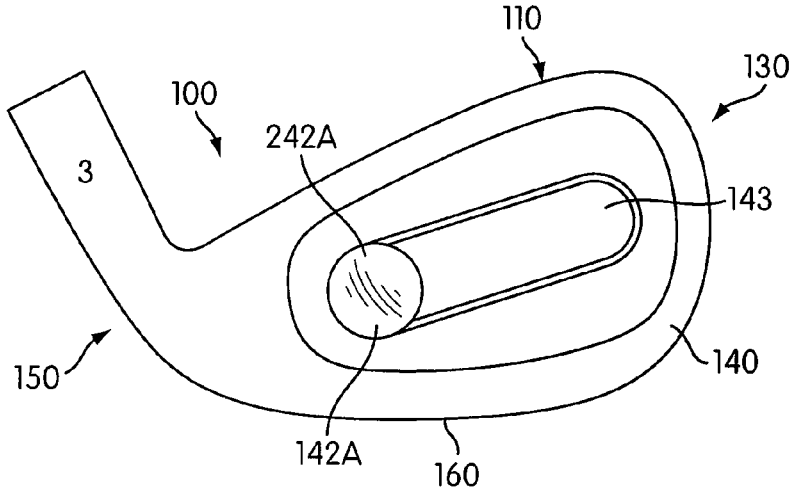
FIGS. 11A-11C are illustrative rear views of golf club heads with center of gravity indicator mechanisms.
Figure 11B:
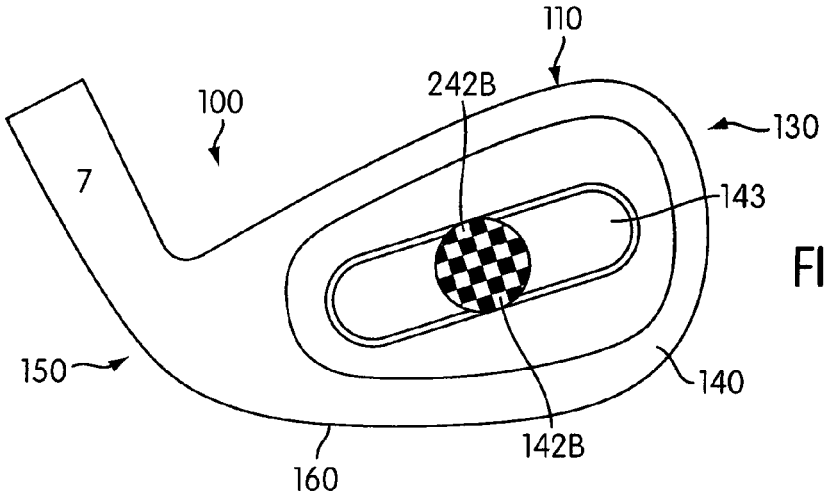
Figure 11C:
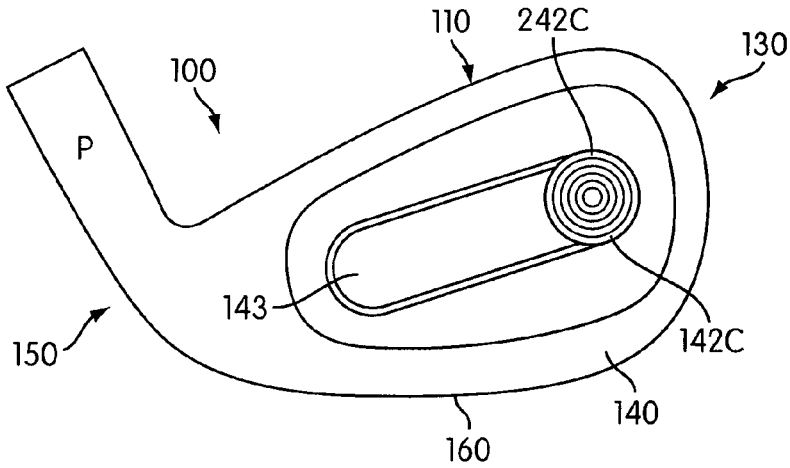

FIGS. 11A-11C are illustrative rear views of golf club heads with center of gravity indicator mechanisms 141 including center of gravity locator structures 142. Here, each of the center of gravity locator structures 142A-C is shown as having a visual perception enhancement feature 242A-C. The visual perception enhancement features 242A-C may include a variety of particular structural and/or surface arrangements that provide improved visual location of the center of gravity locator structure 142A-C so that a golfer can quickly and easily visually perceive the location of the center of gravity of a particular golf club head. Here, for illustrative purposes, visual perception enhancement feature 242A is a reflective surface applied or built into the center of gravity locator structure 142A. This reflective surface 242A draws a golfer's eye and draws attention to the center of gravity facilitating alignment, swing path visualization prior to the swing and other aspects of a addressing a golf ball prior to hitting a golf shot as well as during the golf shot. Visual perception enhancement feature 242B may alternatively (or additionally) be a patterned surface of the center of gravity locator structure 142B. Virtually any pattern or indicia may be utilized in such a manner. Lastly, visual perception enhancement feature 242C, in this configuration can be a grooved surface housed on the center of gravity locator structure 142C. The grooved surface 242C also facilitates visual perception of the structure by a golfer as the varied contours on the surface are quickly perceived by the human eye as compared to a continuous flat surface with little or no change in texture, color or appearance. Further, the cross-hatched depiction of the center of gravity 145 may also serve as a visual perception enhancement feature as described herein. Many other structures, surfaces and features are contemplated as are known in the art.

The present invention is disclosed above and in the accompanying drawings with reference to a variety of embodiments. Portions and features in various configurations described are contemplated as being combined, separated or otherwise used in various ways consistent with that described herein. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

The invention claimed is:

1. A golf club head comprising:

a body including a toe end, a heel end, a top, a bottom, a front side, and a rear side;

a center of gravity indicator housed on the rear side and including a latitudinal strip and a center of gravity locator structure positioned on an axis transverse to the rear side and extending through the center of gravity of the body, wherein the latitudinal strip is askew relative to the bottom of the golf club head, wherein the center of gravity locator structure is housed completely within the latitudinal strip, wherein the bottom of the club head body extends generally from the heel end to the toe end and the latitudinal strip has a longitudinal extent likewise extending in the heel-to-toe direction.

2. The golf club head of claim 1, wherein the latitudinal strip is pill-shaped.

3. The golf club head of claim 2, further comprising a cavity on the rear surface, wherein the center of gravity locator structure is housed in the cavity.

4. The golf club head of claim 3, wherein the center of gravity locator structure is disk shaped.

5. The golf club head of claim 4, wherein the center of gravity locator structure has a diameter equivalent to a distance from the bottom most portion of the latitudinal strip to the top most portion of the latitudinal strip.

6. The golf club head of claim 4, wherein the center of gravity locator structure has varied thickness such that portions of the center of gravity locator structure extend varying distances away from the rear side of the golf club head.

7. A golf club head comprising:

a body including a toe end, a heel end, a top, a bottom, a front side, and a rear side; and a center of gravity indicator housed on the rear side and including a latitudinal strip and a center of gravity locator structure positioned to provide a visual indication of a location of a center of gravity of the body of the golf club head;

wherein the center of gravity locator structure is configured to be variable in position relative to the body of the golf club head, wherein the latitudinal strip is askew relative to the bottom of the golf club head, wherein the center of gravity locator structure is housed completely within the latitudinal strip, wherein the bottom of the club head body extends generally from the heel end to the toe end and the latitudinal strip has a longitudinal extent likewise extending in the heel-to-toe direction.

8. The golf club head of claim 7, wherein the center of gravity locator structure is configured to translate back and forth in a linear direction.

9. The golf club head of claim 8, wherein the center of gravity locator structure is configured to be slidable within the latitudinal strip along a length of the latitudinal strip.

10. The golf club head of claim 9, wherein the center of gravity locator structure is resistively coupled to the latitudinal strip.

11. The golf club head of claim 9, where the center of gravity locator structure includes a grooved edge configured to house one of a top and bottom internal edge of the latitudinal strip so as to facilitate guided translation of the center of gravity locator structure.

12. The golf club head of claim 9, wherein opposing ends of the latitudinal strip are configured to be complementary in shape and size to the center of gravity locator structure such that when the center of gravity locator structure is positioned at one of the opposing ends of the latitudinal strip, the entire opposing end of the latitudinal strip is covered by the center of gravity locator structure.

13. The golf club head of claim 7, wherein the center of gravity locator structure is configured such that an exposed surface of the center of gravity locator structure includes a visual perception enhancement feature including one of a reflective surface, a patterned surface, and a grooved surface.

14. A set of golf club heads comprising:

first, second, and third iron-type golf club heads, each of the first, second and third iron-type golf club heads including:

a body including a toe end, a heel end, a top, a bottom, a front side, and a rear side;

a distinct center of gravity indicator housed on the rear side of the iron-type golf club head and including a latitudinal strip and a center of gravity locator structure positioned on an axis transverse to the rear side and extending through the center of gravity of the body, wherein the latitudinal strip is askew relative to the bottom of the golf club head, wherein the center of gravity locator structure is housed completely within the latitudinal strip, wherein the bottom of the club head body extends generally from the heel end to the toe end and the latitudinal strip has a longitudinal extent likewise extending in the heel-to-toe direction.

15. The set of golf club heads of claim 14, wherein the center of gravity indicator of each of the first, second, and third iron-type golf club heads includes a center of gravity locator structure and wherein the center of gravity indicators are distinct among the first, second, and third iron-type golf club heads in the position of the center of gravity locator structure.

16. The set of golf club heads of claim 14, wherein each of the first, second, and third iron-type golf club heads is coupled to a shaft with a grip housed on an opposing end of the shaft.

17. The set of golf club heads of claim 14, further comprising fourth, fifth, sixth, seventh, and eighth iron-type golf club heads, wherein each of the first through eighth iron-type golf club heads has a varied center of gravity and wherein each of the first through eighth iron-type golf club heads has a distinct center of gravity indicator.

18. The set of golf club heads of claim 17, wherein the center of gravity indicator of each of the first through eighth iron-type golf club heads includes a latitudinal strip and a center of gravity locator disk, the center of gravity indicator of the first through eighth iron-type golf club heads being varied by the position of each of the center of gravity locator disk.

* * * * *